US005552119A

United States Patent [19]

Holmes

[11] Patent Number: 5,552,119

[45] Date of Patent: Sep. 3, 1996

[54] METHOD AND APPARATUS FOR CONTACTING SOLID PARTICLES AND FLUID

[75] Inventor: Philip Holmes, West Horsley, United Kingdom

[73] Assignee: Exxon Research and Engineering Company, Florham Park, N.J.

[21] Appl. No.: 362,329

[22] Filed: Dec. 22, 1994

Related U.S. Application Data

[63] Continuation-in-part of Ser. No. 123,573, Sep. 17, 1993, abandoned, which is a continuation of Ser. No. 778,906, Jan. 9, 1992, abandoned.

[51] Int. Cl.[6] ..... F27B 15/08; C10G 35/00

[52] U.S. Cl. ..... 422/144; 422/139; 422/142; 422/147; 208/157

[58] Field of Search ..... 422/142, 143, 422/144, 147, 214, 139; 239/432; 208/153, 157, 158

[56] References Cited

U.S. PATENT DOCUMENTS

| | | | |
|---|---|---|---|
| 3,959,401 | 5/1976 | Albright et al. | 585/539 |
| 4,523,987 | 6/1985 | Pennick | 208/157 |
| 4,578,183 | 3/1986 | Chou et al. | 208/113 |
| 5,053,203 | 10/1991 | Mauleon et al. | 422/144 |
| 5,112,576 | 5/1992 | Kruse | 422/144 |
| 5,139,748 | 8/1992 | Lomas et al. | 422/140 |

FOREIGN PATENT DOCUMENTS

| | | |
|---|---|---|
| 0180291 | 5/1986 | European Pat. Off. . |
| 0344032 | 11/1989 | European Pat. Off. . |
| 0859246 | 1/1961 | United Kingdom . |
| 1007248 | 10/1965 | United Kingdom . |

*Primary Examiner*—Robert J. Warden
*Assistant Examiner*—Christopher Y. Kim
*Attorney, Agent, or Firm*—Richard D. Jordan; James H. Takemoto

[57] ABSTRACT

A method and apparatus are described for contacting solid particles and fluid. A liquid is sprayed as liquid droplets from the discharge tip of a nozzle into hot solid particles passing upwardly in a vertical pipe. A venturi is formed in the pipe, and the venturi has an entrance portion which is upwardly convergent to the throat and an exit portion which is upwardly divergent from the throat. The tip of the nozzle is so located relative to the venturi that liquid droplets commence vaporization, due to heat transfer from the hot solid particles, no further up stream (relative to the direction of movement of solid particles up the pipe) than the throat of the venturi thereby resulting in a high degree of turbulence which causes good mixing of particles and vapor downstream of the venturi throat. The particles-vapor mixture leaving the exit portion of the venturi is well mixed and particles are substantially uniformly mixed with vapor in radial planes of the pipe downstream of the venturi.

10 Claims, 5 Drawing Sheets

METHOD AND APPARATUS FOR CONTACTING SOLID PARTICLES AND FLUID

This is a continuation in part of U.S. patent application Ser. No. 08/123,573, filed Sep. 17, 1993, now abandoned, which is a continuation of U.S. patent application Ser. No. 07/778,906, filed Jan. 9, 1992, now abandoned.

FIELD OF THE INVENTION

The present invention relates to the contacting of solid particles and fluid. More particularly, but not exclusively, the present invention relates to the contacting of solid particles with a fluid in a reactor, such as the reactor of a catalytic cracker.

BACKGROUND OF THE INVENTION

The contacting of solid particles and fluids (vapor, gas and/or liquid) is a relatively common operation in chemical engineering practice. It is used in adsorption and desorption processes and in variants thereof wherein thermal and/or catalytic conversions are effected. The time of contact between the solid particles and the fluid is one of a number of operating parameters which is receiving attention since the characteristics of related and/or associated chemical and/or physical change and the size of the contacting equipment is affected by contacting time. Another operating parameter of interest is the efficiency of contacting of the solids with the fluid since this, too, can affect important process and equipment features. In processes involving contacting of fluid with a fluidized bed of the solid particles, the particles adjacent to the lateral containing wall of the bed tend not to be as effective in fluid contacting as those remote from the lateral containing wall and this can lead to excessive solids-fluid contact remote from the wall in order to achieve a desired average degree of solids-fluid contacting. In the instance of fluidized catalytic cracking of a hydrocarbon feed, an under utilization of catalyst particles adjacent to the lateral containing wall and an excessive contacting of hydrocarbon feed and cracked products with catalyst remote from the wall tends to result in insufficient cracking of some feed and over-cracking of other feed so that the overall efficiency of the catalytic cracking process is lower than might otherwise be possible.

It is an object of the present invention to provide improved contacting of solid particles and fluid with a view to ameliorating at least some of the foregoing deficiencies. It is a further object of the invention to provide such improved contacting which can be implemented in a reactor for effecting contacting between solid particles and a fluid, and in particular (but not exclusively) in a reactor forming part of a fluidized catalytic cracking unit.

UK patent specification GB-A-859246 describes and claims apparatus for the fluidized catalytic cracking of hydrocarbons comprising a lower tubular fluidization section, an outwardly diverging conical transition section above the fluidization section having an angle of divergence within the range of 0.5° to 2.5° and a tubular cracking section above the transition section, the total length-to-average diameter ratio of the transition section and the cracking section being within the range of 10:1 to 20:1, first conduit means at the bottom of the fluidization section for injecting a gaseous fluidizing medium therein, second conduit means downstream from the first conduit means, for introducing finely divided solids into the fluidization section, and injection means downstream from the second conduit means, for injecting a liquid feed stock into the fluidization section. The top diameter of the transition section is preferably from 2 to 3 times the bottom diameter thereof.

The apparatus of GB-A-859246 thus comprises a zone for the contacting of petroleum hydrocarbons (preferably gas oil fractions boiling in the range 650°–1050° F. (343.3°–565.5° C.) and having at least 30 vol. of components boiling above 800° F. (426.7° C.) with finely divided cracking catalyst, and which zone comprises a first cylindrical vertical riser surmounted by a vertical divergent section connected at its top end to a second vertical cylindrical riser. The diameter of the second cylindrical riser is from 2 to 3 times that of the first cylindrical riser. The hydrocarbon feed is passed into the first cylindrical riser from a plurality of injection nozzles, and the nozzles are depicted as being at an angle of about 45° to the common vertical axis of the risers. The divergent section is located a relatively considerable distance downstream of (i.e., above) the plane at which the feed enters the first cylindrical riser. It is disclosed that a suspension of catalyst in gaseous hydrocarbons is formed in the first riser wherein a conversion reaction is initiated, and during the subsequent upward flow through the divergent section, the flow velocity increases progressively to inhibit retrograde movement of the fluidized catalyst relative to the wall of the divergent section. The vaporized hydrocarbon and suspended catalyst are accelerated to an extent sufficient to provide for a disperse phase suspension of catalyst in vaporized hydrocarbon components at the top of the divergent section.

UK patent specification GB-A 1007248 describes and claims a process for cracking hydrocarbons which comprises passing a suspension of catalyst particles in hydrocarbon vapors as a substantially upflowing stream through a substantially vertically elongated conversion zone, separating spent catalyst particles from cracked hydrocarbon vapors leaving said conversion zone, passing the spent catalyst particles to the upper portion of a substantially vertically elongated separate stripping zone, through sealing means to prevent backflow of vapors from said stripping zone to said conversion zone, passing stripping gas upwardly counter current to downflowing catalyst particles in said stripping zone, removing gaseous material overhead from said stripping zone, withdrawing dense fluidized stripped catalyst particles through a standpipe from the bottom portion of said stripping zone and passing them to the lower portion of a regeneration zone, passing regenerating gas upwardly through the catalyst particles to maintain a dense fluidized bed of catalyst particles while regenerating them, withdrawing regenerated catalyst particles from the lower portion of said regeneration zone and passing them to the lower portion of said elongated conversion zone and introducing hydrocarbon oil into the lower portion of said conversion zone for admixture with the introduced regenerated catalyst particles to form said suspension of catalyst particles above mentioned and circulating solids from said stripping zone to said regeneration zone by maintaining a higher pressure of catalyst particles in the bottom portion of said stripping zone than in the lower portion of said regeneration zone. In the illustrated embodiment, the substantially vertically elongated conversion zone comprises a relatively long, hollow cylindrical reactor, having the form of a relatively wide pipe, which surmounts a narrower, relatively short tube described as the injection section. Hot regenerated catalyst particles are received at the bottom region of the injection section, and they are entrained upwardly into the reactor by steam which is injected at the base of the injection section. Feed which is to be cracked is injected into the bottom portion of the reactor for admixture with the upflowing suspension of catalyst particles in steam from the injection section. The oil feed is atomized and vaporized and mixed with the catalyst particles so that the suspension of catalyst particles in oil vapor passes upwardly in the reactor at a velocity between about 3 and 12 m/s. At spaced elevations along the interior of the reactor, there are provided venturi shaped contacting devices. The venturi contacting devices ensure co-current contacting between the solid and vaporous materials, and in particular, the mainly solids containing stream which passes downwardly along the walls and the main stream or suspension of solid catalyst passing up through the center of the reactor. There is no disclosure or suggestion in GB-A-1007248 of contacting droplets of oil feed and catalyst particles in any of the venturis or in any particular region of any of them.

SUMMARY OF THE INVENTION

The present invention provides, in one aspect, a method of contacting hot solid particles and a fluid comprising passing hot solid particles to a venturi having a convergent entrance portion, a throat and a divergent exit portion, and passing fluid in the form of liquid droplets into the throat and/or exit portion of the venturi, vaporizing liquid droplets in the said throat and/or exit portion by heat exchange with solid particles therein, and recovering from the exit portion of the venturi a dispersion of solid particles in fluid vapor.

Preferably, the dispersion of solid particles in fluid vapor is recovered via a pipe connected to the exit portion of the venturi.

The fluid may be a hydrocarbon mixture and the particles may comprise a catalyst for catalyzing a change in the composition of the hydrocarbon mixture. Preferably, the catalyst exerts its catalytic action on the hydrocarbon mixture during vapor phase contacting which substantially starts no further upstream (relative to the direction of flow of fluid and particles through the venturi) than the throat of the venturi. Preferably, the particles comprise a hydrocarbon cracking catalyst.

Preferably, particles and vapor are separately recovered from the particles-vapor dispersion at the downstream end of the said pipe connected to the venturi, and carbonaceous deposits on the recovered particles are at least partially removed by contacting the recovered particles in a regeneration zone with an oxygen-containing gas in an elevated deposit-removing temperature. Preferably, hot particles are recovered from the regeneration zone and circulated to the venturi for contact with further amounts of liquid droplets initially in the throat and/or divergent exit portion thereof.

Preferably, particles are accelerated through the entrance portion of the venturi by the energy of the fluid and are substantially thoroughly mixed with fluid vapor in the throat and/or exit portion of the venturi.

In another aspect, the invention provides apparatus for contacting hot solid particles and a fluid, the apparatus comprising a venturi having a convergent entrance portion, a throat and a divergent exit portion, an inlet tube for conducting hot solid particles to the inlet of the convergent entrance portion, and at least one nozzle for discharging liquid droplets of the fluid into the throat and/or exit portion of the venturi, whereby the liquid droplets are vaporized in the throat and/or exit portion of head exchange with hot solids thereby forming a dispersion of solid particles in fluid vapor.

The apparatus may comprise a pipe for conducting the dispersion of solid particles in vapor from the exit portion of the venturi to a dispersion-recovery zone.

There may be provided separating means for separately recovering particles and vapor from the dispersion recovered in the dispersion-recovery zone.

The apparatus may comprise a regeneration zone connected for receiving particles from the separating means and operative for heating the particles received therein. Preferably, the said inlet tube is connected to the regeneration zone for receiving and conducting heated particles therefrom.

Preferably, the regeneration zone comprises means for contacting particles received from the separating means with an oxygen-containing gas to remove combustible deposits from the particles in an exothermic oxidation reaction which heats the particles.

The venturi may be formed by a venturi-shaped refractory mass, optionally reinforced, between the inlet tube and the said pipe.

Preferably, the said nozzle is a hydrocarbon feed discharge nozzle having its discharge port located and spaced at a selected distance from the throat of the venturi so that hydrocarbon feed discharged therefrom is in the form of oil droplets at the throat and/or exit portion of the venturi.

Preferably, the length of the said pipe is selected to give a particles-vapor contacting time of less than 15 seconds.

The present invention also provides a catalytic cracking unit comprising apparatus as described.

The nozzles may be arranged for passing fluid into the venturi with a component of velocity in the direction of flow of solids and vapor.

In some embodiments, the direction of flow of solids and vapor through the venturi will be upwards, and in other embodiments downwards.

The nozzles may be arranged relative to the pipe for injecting fluid into the pipe substantially radially with respect to the central axis of the venturi. Alternatively, the or each nozzle may be arranged relative to the venturi for passing fluid thereinto at an angle exceeding 0° relative to a radius the central axis of the venturi. In this type of embodiment, each nozzle is preferably arranged to pass fluid into the venturi with a least a tangential component of velocity.

In another aspect, the present invention provides a fluidized catalytic cracking unit comprising a reactor in which a hydrocarbon feed is contacted with solid catalyst particles at catalytic cracking conditions to convert the feed to cracked products, which are recovered, and a regenerator wherein coke-comprising catalyst particles from the reactor are contacted with an oxygen-containing gas to remove coke by oxidation and thereby heat the catalyst particles which are thereafter returned to the reactor, and wherein the reactor is formed, at least in part, by apparatus as described herein. Preferably, the cracking unit comprises a separator for separating catalyst particles from cracked products.

BRIEF DESCRIPTION OF THE DRAWINGS

The invention will now be further described with reference to some non-limitative embodiments thereof and with reference to the accompanying diagrammatic drawings in which.

Figure 1:
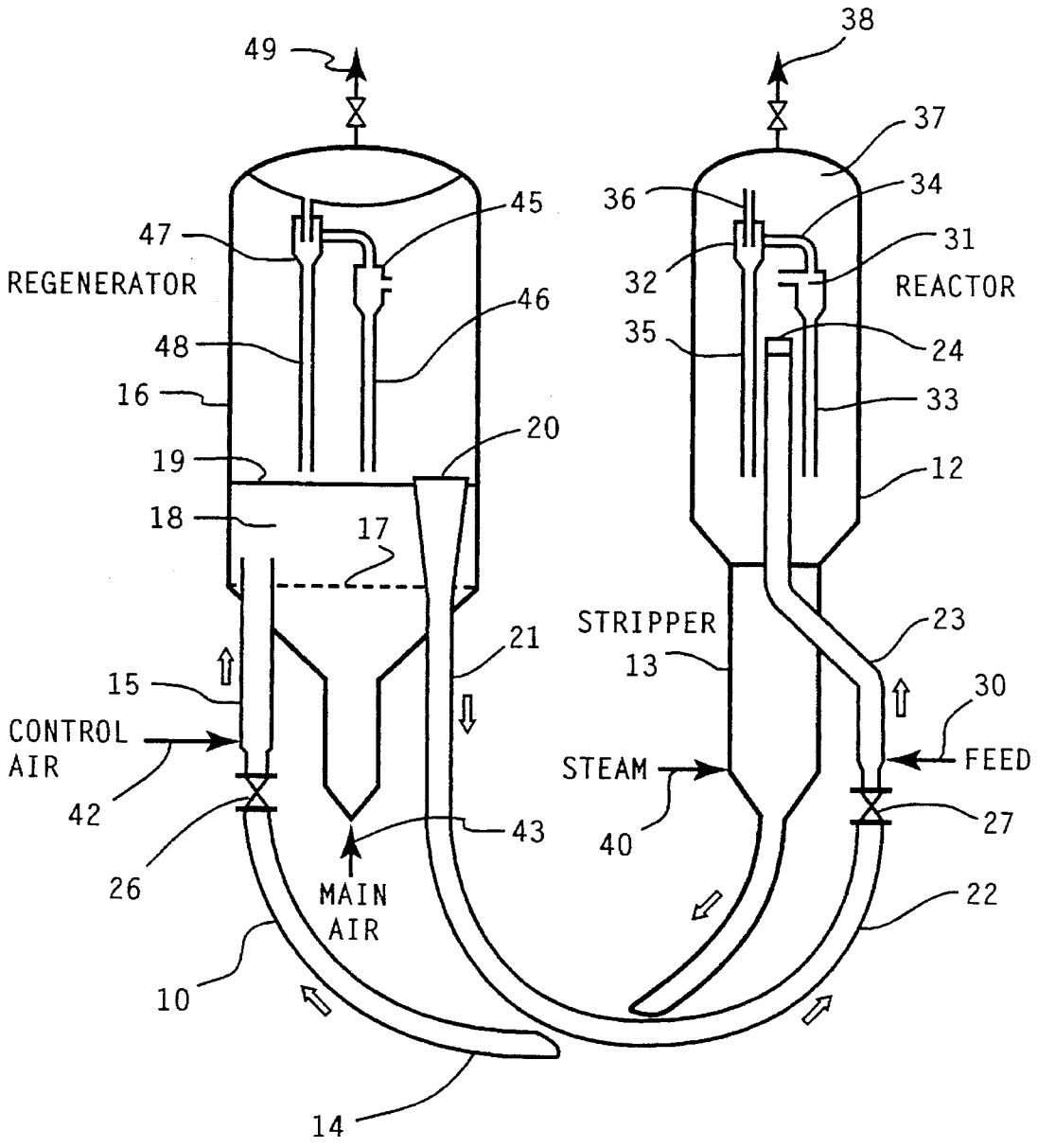
FIG. 1 is a diagram (not to scale) of the principal features of a known fluidized catalytic cracking unit "(FCCU")

In the drawings, only those features which are necessary for an understanding of the invention are shown or depicted.

DETAILED DESCRIPTION OF THE INVENTION

Reference is first made to an FCCU 10 of FIG. 1 which comprises a reactor vessel 12 surmounting a stripper 13, the conical bottom of which communicates via a U-bend pipe 14 with an upwardly-extending riser 15, the top of which is located within a regenerator vessel 16 at a level above the conical bottom thereof and slightly above a perforated grid 17 which extends across the top of the conical bottom. The regenerator 16 contains fluidized particles of cracking catalyst in a bed 18 which extends up to a top level 19 in the regenerator. Catalyst which tends to rise above level 19 overflows into the top region 20 of a downcomer 21 which is connected to one end of a u-bend pipe 22. The other end of the pipe 22 is connected to a riser 23 which extends substantially vertically and generally upwardly to a termination device at its top end to define the upper limit of the riser 23. Each U-bend pipe 14 and 22 has a respective closure valve 26, 27 for emergency and maintenance closing of the flow passages therethrough.

The U-bend pipes 14 and 22 are each shown in FIG. 1 as substantially symmetrical structures. However, those knowledgeable and/or skilled in the art will know or appreciate that one or both U-bend pipes 14 and 22 may be asymmetrical. For example, in one well-known variant of the symmetrical U-bend pipe 22, the riser pipe 23 may extend vertically downwards further than shown in-FIG. 1, and the pipe 22 may be inclined downwards from the downcomer 21 so that the junction of the riser pipe 23 and the pipe 22 has a form approximating to the letter 'J' or the form of a hockey club. As indicated above, this and other variants are known or will be appreciated by those knowledgeable and/or skilled in the art.

In broad terms, the operation of the FCCU 10 proceeds as follows: a hydrocarbon feed, usually consisting of, or containing, fractions boiling in the gas oil range and higher, is passed into a lower part of the riser 23 from a feed line 30. Usually, the feed from line 30 is introduced into the riser 23 via a plurality of injectors (not shown) arranged equiangularly around riser 23. Hot regenerated catalyst particles passing upwardly through the riser 23 mix with, and heat, the injected feed in the riser 23 at the level of the feeds injectors and higher causing selective catalytic conversion of the feed to cracked products, which include vapor-phase cracked products, and carbonaceous and tarry cracked products which deposit on, and within the pores of, the catalyst particles. The feed is usually atomized to dispersed liquid droplets by steam which is passed into the injectors 23 from a steam manifold (not shown). The mixture of catalyst particles and vapor-phase products enters the reactor vessel 12 from the riser 23 via horizontal apertures (now shown) in the termination device 24. This promotes the separation of solids from vapors in the reactor vessel 12. Vapors together with entrained solids pass into a cyclone separation system which is herein shown to comprise two cyclones 31 and 32. The cyclone 31 provides primary separation of vapors and entrained solids, a major part of the latter being returned to the base of vessel 12 via a dipleg 33. The solids-depleted vapors from primary cyclone 31 are conducted via pipe 34 to the secondary cyclone 32 for further solids-separation, the separated solids being returned to the base of vessel 12 via dipleg 35, plenum 37 and product line 38.

The catalyst particles from riser 23, together with separated solids from the cyclones 31 and 32, pass downwardly into the top of the stripper 13 wherein they are contacted by upwardly-rising steam injected from line 40 near the base thereof. The steam strips from the particles adsorbed and occluded strippable hydrocarbons, and these, together with the stripping steam, are recovered with the cracked products in product line 38.

Stripped catalyst particles bearing carbonaceous deposits circulate from the conical base of stripper 13 via the U-bend pipe 14 and the riser 15 into the bed 18 of catalyst particles contained in the regenerator vessel. The circulation of particles via the pipe 14 is promoted by control air which is passed into a lower region of the riser 15 from line 42.

The catalyst particles in the bed 18 are fluidized by air passed into the base of regenerator vessel 16 from line 43. The air oxidatively removes carbonaceous deposits from the particles and the heat of reaction (e.g., combustion and/or part-combustion) raises the temperature of the particles in the bed to temperatures suitable for cracking the feed hydrocarbons. Hot regenerated catalyst overflows the top region 20 of the downcomer 21 and passes via the downcomer 21 into the U-bend pipe 22 for contact with further quantities of feed supplied from line 30.

The spent air passing upwardly from the top level 19 of the bed 18 in regenerator vessel 16 enters a primary cyclone 45 for separation of entrained particles, the latter being returned to the bed 18 via a dipleg 46. A further stage of solids-separation is effected by secondary cyclone 47 which receives the solids-depleted gas from the primary cyclone 45, the separated solids being returned to the bed 18 via a dipleg 48. Spent air is recovered from the top of the regenerator vessel conduct 49, according to the prior art.

Figure 2:
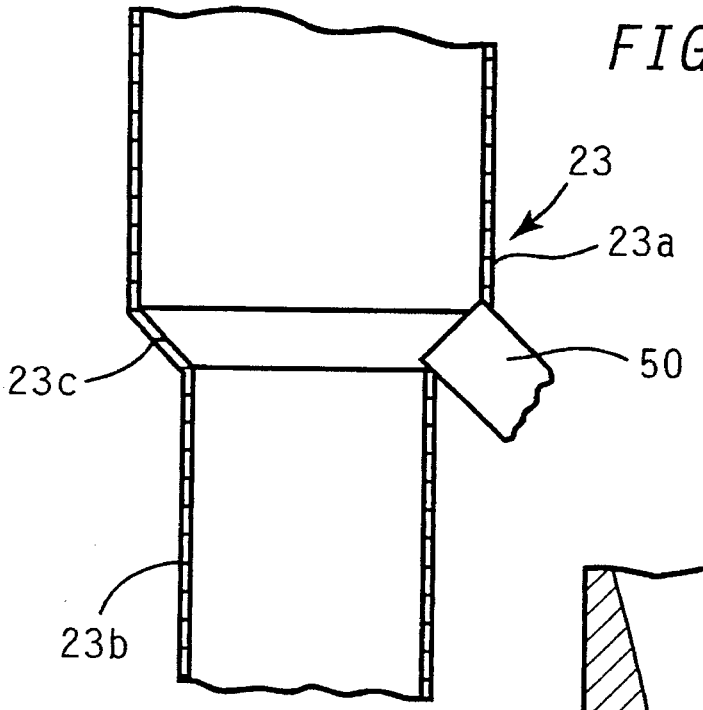
FIG. 2 is a diagrammatic cross-section of a part of the FCCU of FIG. 1, but to a larger scale.

Reference is now made to FIG. 2 of the drawings which depicts, diagrammatically and to a larger scale, the principal features of the region of the riser 23 where the feed is injected from line 30.

The riser 23 has an upper part 23*a* which surmounts a lower part 23*b* of smaller horizontal cross-sectional flow area. An upwardly-divergent connecting part 23*c* connects the top of the lower part 23*b* with the bottom of the upper part 23*a*. A plurality of feed injection nozzles is symmetrically arranged around the riser 23 to inject feed in the form of steam-atomized liquid hydrocarbon droplets from the feed line 30 (Figure) into the riser. The nozzles receive feed via a manifold (not shown). In FIG. 2, a single one of the injectors is shown for the sake of simplicity. The injector 50 is connected to the connecting part 23*c* of riser 23 with its axis in the radial plane of the riser 23, and it is inclined upwardly so that feed passes into the riser with an upward component of velocity. The contacting of the feed with hot regenerated catalyst causes conversion of the feed to vapors including cracked products, and the increased volume due to vapor phase components tends to accelerate the catalyst upwardly.

It has been observed that the densities and velocities of the vapors and catalyst particles in the riser 23, according to the prior art shown in FIG. 2, may be considerably non-uniform As a result, in some regions catalyst particles may have relatively excessive contact with feed and vapor products and in other regions relatively insufficient contact. This gives a wide range of reaction conditions which, in the extremes, cause undesirable thermal cracking, excessive catalytic cracking and simple vaporization of feed. Dry gas yield (i.e., $C_2$-hydrocarbons and hydrogen) and the amount of carbonaceous deposit ("coke") on the catalyst particles (coke yield) are thereby increased at the expense of the more valuable lighter liquid products.

Figure 3:
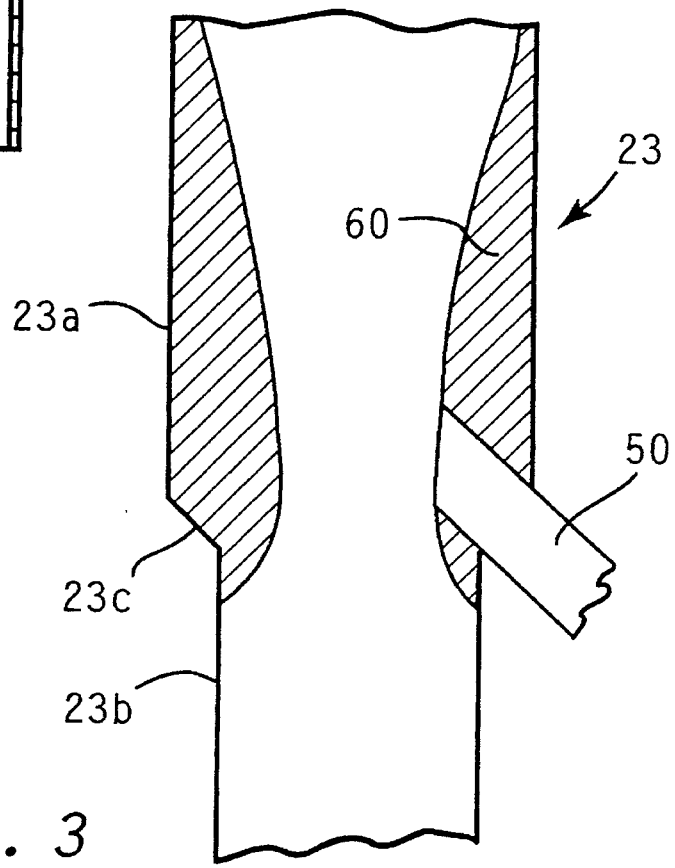
FIG. 3 is a diagrammatic cross-section of the same part as in FIG. 2, but showing instead one embodiment according to the invention.

Reference is now made to FIG. 3 of the drawings which depicts the same region of a riser 23 as is shown in FIG. 2, but constructed in accordance with the invention.

In the arrangement shown in FIG. 3, parts which are equivalent to those in FIG. 2 are given the same reference numerals.

It will be seen that the lower part 23*b* of the riser 23, immediately below the feed injection nozzles 50, is formed with a cross-section which reduces progressively and smoothly in an upward direction and then increases progressively and smoothly in the upward direction within the upper part 23*a* of the riser 23 so as to form a venturi-like arrangement having the narrowest part or throat in substantially the same horizontal plane as the injection nozzles. In the embodiment shown, the venturi-like arrangement is formed by providing the lower part 23*b*, the connecting part 23*c* and the upper part 23*a* of the riser with a lining 60 which has the desired internal shape and is adequately resistant to the conditions of operation for an economical life. Alternatively, the wall of the riser 23 itself may be formed to provide the venturi-like arrangement.

The nozzles 50 (of which only one is shown in FIG. 3) are located and arranged to spray the hydrocarbon oil feed in the form of oil droplets into the throat and exit portion of the venturi so that the principal initial region of content of oil droplets with hot catalyst particles is substantially no further upstream (relative to the direction of movement of the catalyst particles and vapor through the venturi) than the throat of the venturi. As a result of this arrangement, the energy of the feed is shared with the catalyst particles in the venturi causing rapid acceleration of the catalyst particles to velocities approximating to the velocity of the feed in the venturi, and the contacting of oil droplets with catalyst particles in the venturi throat and downstream thereof results in vaporization of oil droplets substantially starting at the throat or downstream thereof in the venturi (e.g., between the throat and the divergent exit portion of the venturi). The vaporization of oil droplets results in the production of large volumes of oil vapor in the venturi principally in the throat thereof and/or downstream. Catalyst particles are substantially uniformly dispersed in the oil vapor in the venturi principally in the throat thereof and/or downstream. Catalyst particles are substantially uniformly dispersed in the oil vapor by the high degree of turbulence substantially commencing in the throat and/or divergent section of the venturi. Thus, the catalyst/vapor mixture leaving the downstream end of the venturi into the part 23*a* of the riser is highly turbulent and of substantially uniform composition in radial planes of the riser, and the catalyst particles move upwardly in the part 23*a* with velocities approximating to the local velocities of vapor therein.

The venturi-like arrangement promotes relatively uniform acceleration of the catalyst particles by more efficient transfer of energy from the liquid hydrocarbon feed sprayed as droplets into the more slowly moving catalyst phase. The resulting turbulence in the divergent section enhances catalyst/oil contacting and provides for more uniform vaporization. Hence, catalyst particles at the top of the upper part 23*a* of the riser 23 have a higher upward velocity (i.e., reduced slip relative to the entraining fluid) with a relatively flatter velocity profile across the riser 23, and are relatively more uniformly mixed with the vaporized feed than is the case in the riser depicted in FIG. 2 when operating under the same conditions (of e.g. feed rate catalyst rate, temperature and pressure). As a result, vaporized feed hydrocarbons are more uniformly cracked in the more desirable and controlled catalytic manner as catalyst and vapor continue their transit up the riser into the reactor and its separation devices. Accordingly, the production of dry gas ($C_2$-hydrocarbons and hydrogen) and the amount of carbonaceous deposit (coke yield) on the catalyst are reduced and there is a corresponding increase in the more valuable lighter liquid products relative to those obtainable in the FIG. 2 embodiment operating at the same conditions.

Figure 3A:
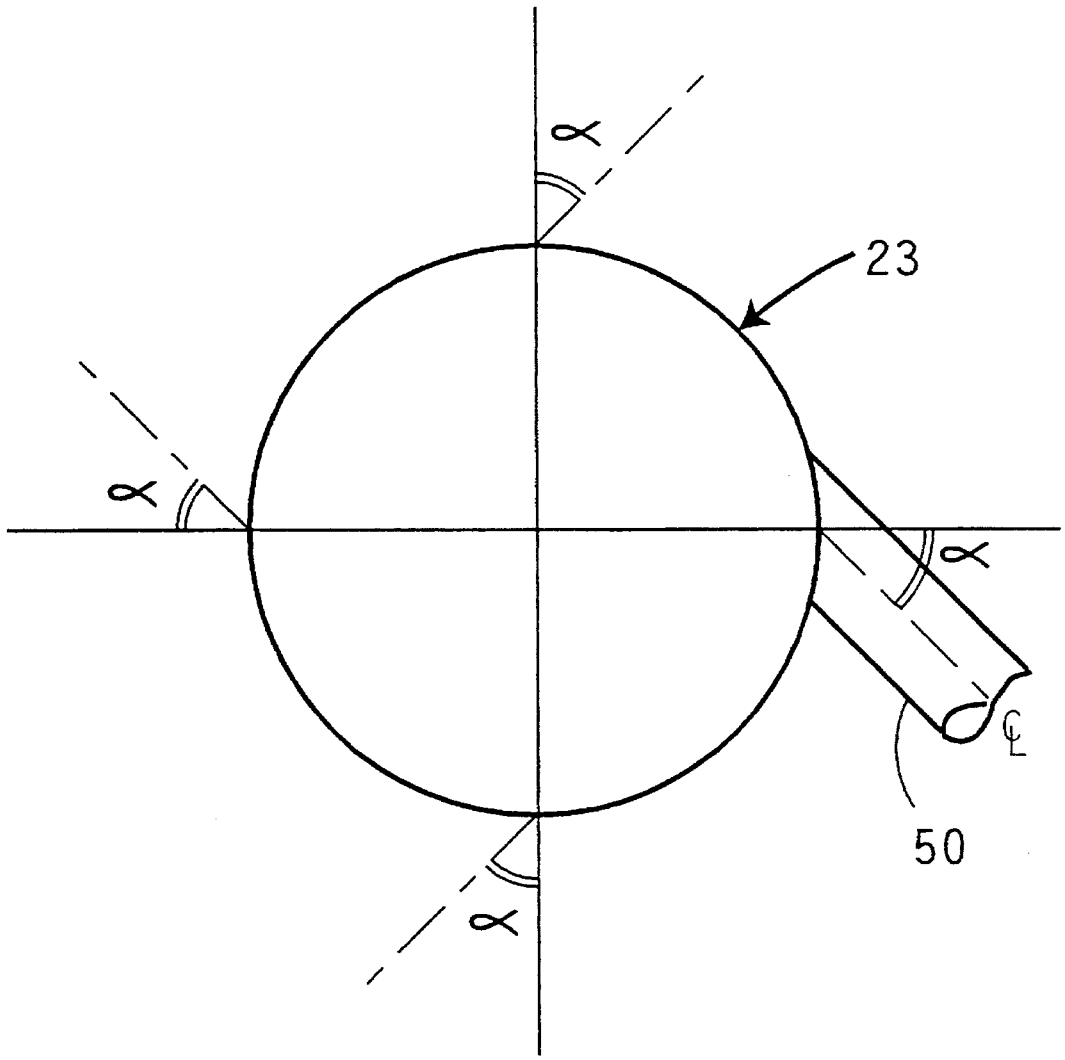
FIG. 3*a* is a diagrammatic cross-section through the embodiment shown in FIG. 3 which details the radial positioning of fuel injectors within the riser.

In FIG. 3, the feed injector 50 is depicted as having its axis in a radial plane of the riser 23, in the same manner as in FIG. 2. As shown in FIG. 3*a*, the feed injectors may each have their axes turned in the same sense so as to intersect the respective radial planes of the riser 23 at an angle exceeding 0° (e.g. in the range 30 to 85° ), whereby the injected feed and the vapors resulting therefrom have a tangential component of velocity. The vapors tend to spiral up the venturi-like region of the upper part 23*a* of the riser thereby tending to reduce the thickness of the low-velocity vapor region adjoining the internal wall of the upper part 23*a* of the riser so that the tendency of catalyst particles to form a dense, slow-moving film or sheath over the internal wall of the upper part 23*a* of the riser 23 is reduced. This enhances catalyst and oil contacting and provides for more uniform vaporization.

Figure 4:
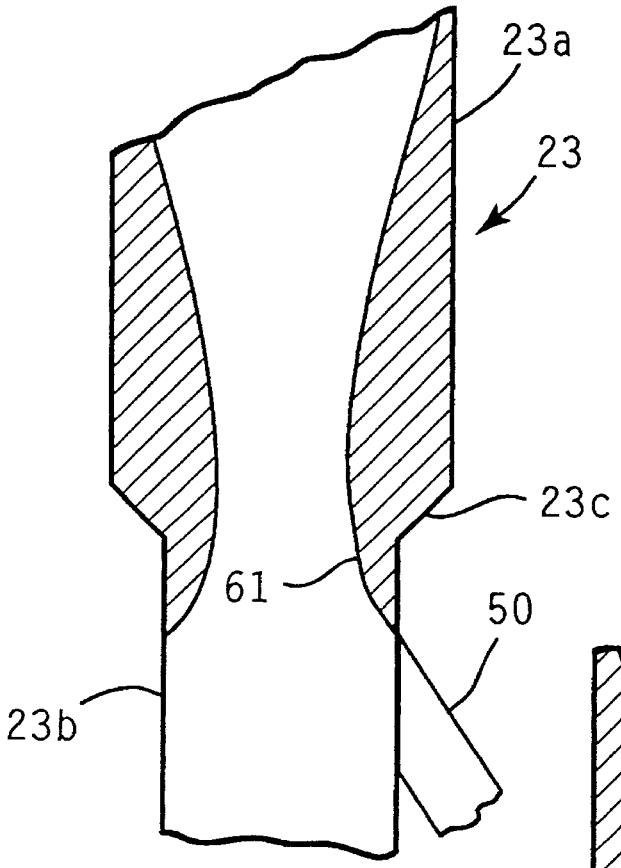
FIG. 4 is a diagrammatic cross-section similar to FIG. 2, but showing instead another embodiment according to the invention.

Reference is now made to the embodiment of FIG. 4 wherein the smoothly or progressively converging and diverging venturi-like arrangement 61 in the riser 23 is similar to that depicted in FIG. 3; however, in FIG. 4, the nozzles 50 inject feed upstream of the arrangement 61 in the lower part 23*b* of the riser 23, rather than into the narrowest part or throat thereof. This disposition provides similar benefits to those of the FIG. 3 embodiment but provides for vaporization of the liquid hydrocarbon feed droplets being substantially coincident with the region of the entrance into the diverging section (e.g., between the throat and the divergent exit portion of the venturi). This offers benefits when processing very heavy feeds of high boiling point which do not vaporize so readily and require a longer mixing length in the riser.

In the FIG. 4 embodiment, as shown in the embodiment of FIG. 3*a*, the feed injectors 50 are arranged so that their respective axes intersect corresponding radial planes of the riser 23 at an angle exceeding zero (e.g., in the range 30° to 85°) so that the injected feed has a tangential component of velocity.

Figure 5:
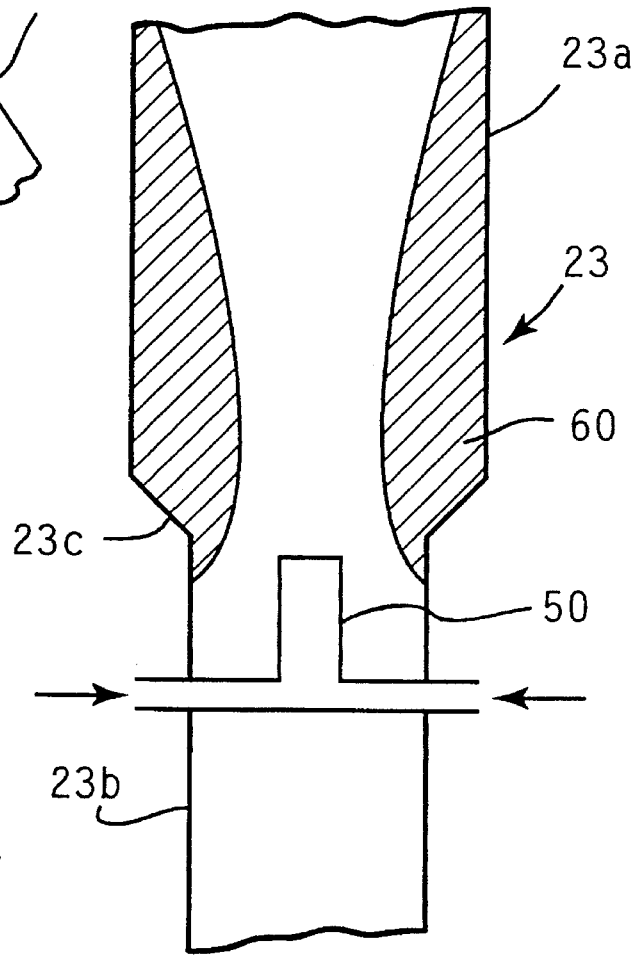
FIG. 5 is a diagrammatic cross-section of another embodiment or variant of the part shown in FIG. 2.

Reference is now made to the embodiment of FIG. 5 which is similar to the embodiment of FIG. 4 except that the feed is injected in an axial direction of the riser 23 from one or more central nozzles 50 (only one being shown in Figure), the discharge tip of which is in a horizontal plane slightly above the horizontal plane of the bottom end of the venturi arrangement in the riser. The feed is passed into the riser as atomized droplets of liquid feed under the action of steam (in the known manner), and the relative locations of the tip of the nozzles(s) 50 and the venturi are such that oil feed droplets substantially commence vaporization no further upstream than the throat or the start of the divergent section of the venturi (e.g., between the throat and divergent exit portion of the venturi). As a result, substantially unvaporized droplets share their energy with catalyst particles entering the venturi thereby accelerating them into the venturi, and the vaporization of oil droplets in the throat and/or divergent section thereof results in a high degree of turbulent and a good dispersion of catalyst particles in oil vapor.

Figure 6:
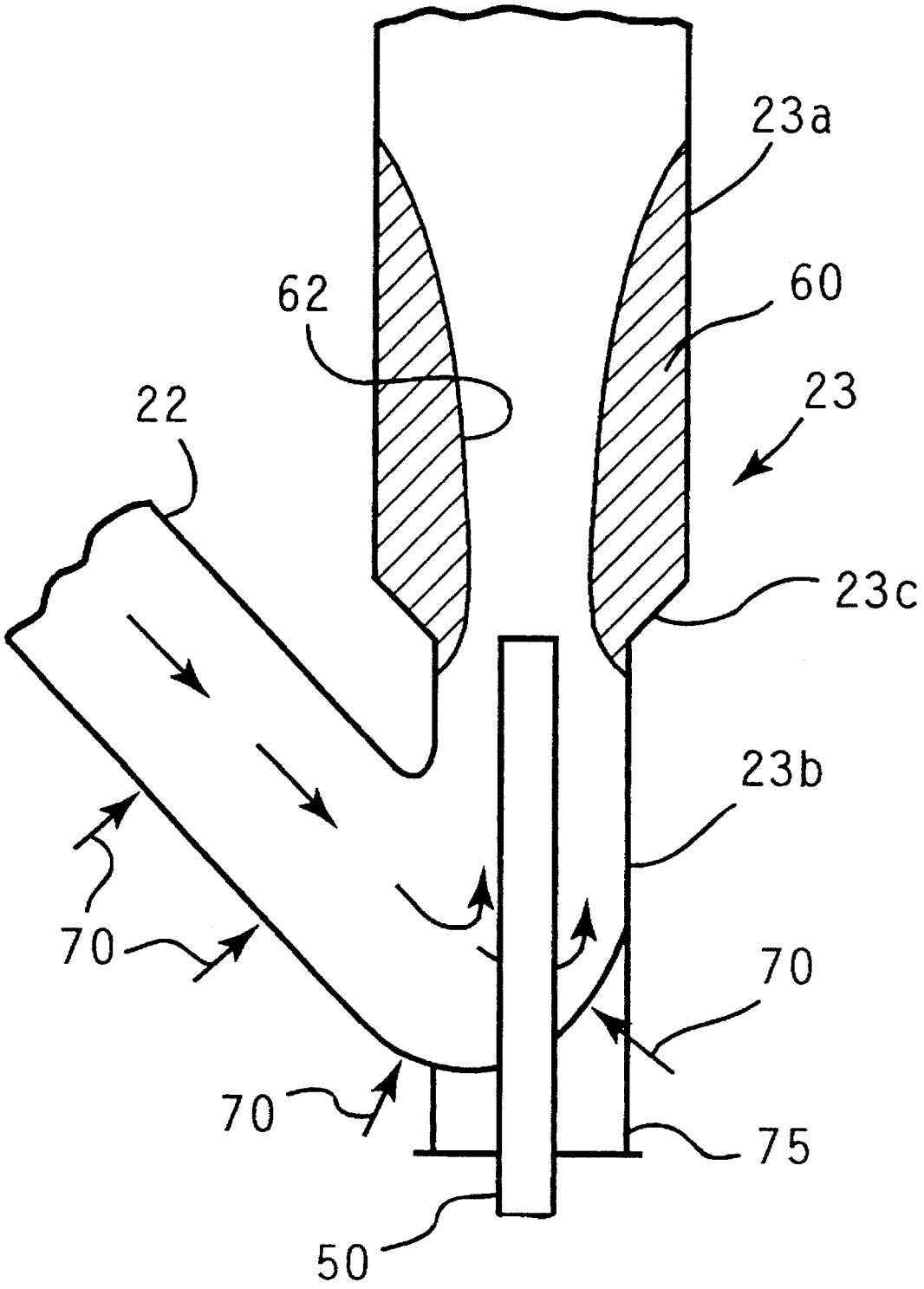
FIG. 6 is a diagrammatic cross-section of yet another embodiment or variant of the part shown in FIG. 2.

Reference is now made to the embodiment of FIG. 6. In this embodiment, the regenerated catalyst return pipe 22 is not in the form of a substantially symmetrical 'U' as depicted in FIG. 1, but slopes downwardly from the lower end of the downcomer 21, (FIG. 1 ) to its junction with the lower end of riser 23. Junctions of this type are well-known and are designated 'J-bends' because of their resemblance to the letter J.

The lower part 23*b* of the riser is connected to the lower end of the pipe 22 so as to provide a relatively smooth change of direction for catalyst particles passing from the pipe 22 into the riser 23. The wider upper part 23*a* of the riser is connected to the top end of the lower part 23*a*. As in the embodiments of FIGS. 3, 4 and 5, a short divergent transition section 23*c* provides the mechanical connection between the lower and upper parts 23*b*, 23*a* of the riser 23. A venturi-like arrangement is formed internally in the riser 23 by a refractory mass 60, which is so formed that the internal diameter of the interior of the riser 23 is progressively reduced in an upward direction when passing from the lower part 23*b* to the upper part 23*a* until the throat 62 of the venturi is reached (just above the transition section 23*c*, as depicted in FIG. 6) and thereafter progressively increased until the internal diameter is equal to that of the upper part 23*a* of the riser 23 at the top of the refractory mass 60.

A vertical feed injection nozzle 50 extends upwardly through the bottom of the J-bend and terminates slightly above the lower end of the venturi-like arrangement, and below the throat 62 thereof.

During operation, hot regenerated catalyst particles pass down the pipe 22 from the regenerator bed 18 (FIG. 1 ) and the downcover 21 (FIG. 1 ), and then circulate upwardly into the riser 23, as indicated by the arrows. The hot catalyst particles are accelerated upwardly into the throat of the venturi by sharing the energy of hydrocarbon feed droplets discharged from the tip of the injector 50 within the convergent part of the venturi. The resulting efficient energy transfer between the hydrocarbon droplets and catalyst particles causes the latter to be accelerated to velocities approximating those of the hydrocarbon droplets entering the throat of the venturi. The discharge tip of the injector 50 is so located relative to the venturi that vaporization of oil droplets discharged from the injector tip substantially commences no further upstream in the venturi than the throat thereof due to heat transfer form catalyst particles at that region (e.g., between the throat and the divergent exit portion of the venturi). As a result, a relatively great increase in vapor phase material substantially commences no further upstream than the throat of the venturi, causing relatively high turbulence which causes good catalyst/oil vapor mixing no further upstream than the throat of the venturi. The catalyst/oil vapor mixing leaving the downstream end of the venturi is, as a result, relatively uniform in radial planes of the riser 23, and the catalyst particles pass up the riser with velocities approximating to the local velocities of hydrocarbon vapors.

In order to prevent catalyst particles accumulating and packing in the J-bend of the FIG. 6 embodiment, an 'aerating' or fluidizing gas or vapor (preferably steam) is passed into the bottom of the pipe 22 (and of the J-bend connection to the riser 23 ) from pipes 70. The J-bend is supported by suitable structural parts, some of which are depicted as item 75 in FIG. 6.

Although the bulk density of catalyst particles can be reduced and acceleration of catalyst particles to velocities approximating those of the hydrocarbon feed vapors can be achieved by injecting gas or vapor (such as steam) into the riser 23 (e.g., a riser 23 of known type, such as that depicted in FIG. 2), the gas or vapor would take up some of the capacity of the reactor 12 and the product recovery and separation equipment (not shown) associated therewith, thereby reducing the maximum feed throughput capacity of the FCCU. The reaction of the present invention avoids this drawback.

Those skilled in the art will appreciate or know the types of feed injection nozzles most appropriate for optimum operation of the apparatus of the invention. For example, in the embodiment of FIG. 3, the preferred type of nozzle(s) would be those which discharge oil droplets in the form of a fan-shaped planar spray, e.g., which subtends an arc on the opposite wall of the venturi. In the embodiments of FIGS. 4, 5 and 6, it would be preferred to employ nozzles of the types which discharge a solid cone of oil droplets.

In the described embodiments, the lower part 23*b* of the riser 23 is illustrated as narrower than the upper part 23*a*. However, the invention may be applied to embodiments where the upper part 23*b* has substantially the same diameter as the lower pan 23*a*, or even where it has a smaller diameter.

It will be appreciated that the rector of the invention can be applied to existing FCCUs in addition to the FCCUs.

It will also be appreciated that although specific embodiments described and illustrated herein relate to reactors of the riser type wherein the catalyst particles and entraining fluids pass upwardly there through, it is within the ambit of the invention to employ risers wherein the catalyst particles and entraining fluids pass downwardly so that advantageous use can be made of the gravitational acceleration of the catalyst particles downwardly through the riser to reduce residence and contact times therein. In essence, such downwardly-acting risers are similar to those described and illustrated but are inverted, with whatever adaption is necessary and/or desirable for their effective operational functioning, as will be apparent to those skilled in the art.

A feature of combination of features described herein in relation to one embodiment without departing from the scope of the invention as defined in the claims which follow.

What is claimed is:

1. A riser for contacting regenerated catalyst particles from a fluidized catalytic cracking regenerator with a hydrocarbon feed, comprising:

a venturi means within the riser having a convergent entrance portion, a throat and a divergent exit portion, wherein the entrance portion has a cross-section which reduces progressively and smoothly toward the throat and increases progressively and smoothly toward the divergent exit portion;

a riser inlet means for supplying all of the regenerated catalyst particles from the fluidized catalytic cracking regenerator directly to the convergent entrance portion of the venturi means;

a hydrocarbon feed inlet means for injecting hydrocarbon feed external to the venturi and within the riser to contact the hydrocarbon with all of the regenerated catalyst particles supplied from the riser inlet means so that the hydrocarbon feed commences vaporization between the throat and the divergent exit portion of the venturi means; and a riser outlet means for transporting all of the regenerated catalyst particles and vaporized hydrocarbon feed from the divergent exit portion of the venturi means.

2. The riser of claim 1, wherein a lining defines the convergent entrance portion and the divergent exit portion of the venturi.

3. The riser of claim 1, wherein the hydrocarbon feed inlet means has a nozzle for spraying the hydrocarbon feed into the convergent entrance portion of the venturi.

4. The riser of claim 3, wherein the nozzle has means for injecting the hydrocarbon feed in an axial direction of the venturi.

5. The riser of claim 1, wherein the hydrocarbon feed inlet means has a nozzle for injecting the hydrocarbon feed in a radial plane of the riser at an angle ranging from 30° to 85°.

6. A riser for contacting regenerated catalyst particles from a fluidized catalytic cracking regenerator with a hydrocarbon feed, comprising:

a venturi means within the riser having a convergent entrance portion, a throat and a divergent exit portion, wherein the entrance portion has a cross-section which reduces progressively and smoothly toward the throat and increases progressively and smoothly toward the divergent exit portion;

a riser inlet means for supplying all of the regenerated catalyst particles from the fluidized catalytic regenerator directly to the convergent entrance portion of the venturi means;

a hydrocarbon feed inlet means for injecting hydrocarbon feed within the venturi means so that the hydrocarbon feed is injected in a radial plane of the riser at an angle ranging from 30° to 85° so that the injected hydrocarbon feed has a tangential component of velocity; and a riser outlet means for transporting all of the regenerated catalyst particles and injected hydrocarbon feed from the divergent exit portion of the venturi means.

7. The riser of claim 6, wherein a lining defines the convergent entrance portion and the divergent exit portion of the venturi.

8. A riser for contacting regenerated catalyst particles from a fluidized catalytic cracking regenerator with a hydrocarbon feed, comprising:

a venturi means within the riser having a convergent entrance portion, a throat and a divergent exit portion, wherein the entrance portion has a cross-section which reduces progressively and smoothly toward the throat and increases progressively and smoothly toward the divergent exit portion;

a riser inlet means for supplying all of the regenerated catalyst particles from the fluidized catalytic cracking regenerator directly to the convergent entrance portion of the venturi means;

a hydrocarbon feed inlet means for injecting hydrocarbon feed along a horizontal plane of the riser to contact the hydrocarbon feed with all of the regenerated catalyst particles within the venturi means so that the hydrocarbon feed commences vaporization between the throat and the divergent exit portion of the venturi means; and a riser outlet means for transporting all of the regenerated catalyst particles and vaporized hydrocarbon feed from the divergent exit portion of the venturi means.

9. The riser of claim 8, wherein a lining defines the convergent entrance portion and the divergent exit portion of the venturi.

10. The riser of claim 8, wherein the hydrocarbon feed inlet means has a nozzle for spraying the hydrocarbon feed into the convergent entrance portion of the venturi.

* * * * *